US007290360B2

(12) United States Patent
Unzicker et al.

(10) Patent No.: US 7,290,360 B2
(45) Date of Patent: Nov. 6, 2007

(54) EXCAVATION APPARATUS

(75) Inventors: Mark Unzicker, Edmond, OK (US); Mark Cooper, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 11/535,830

(22) Filed: Sep. 27, 2006

(65) Prior Publication Data

US 2007/0119078 A1 May 31, 2007

Related U.S. Application Data

(62) Division of application No. 11/236,104, filed on Sep. 26, 2005, now Pat. No. 7,152,348.

(51) Int. Cl.

| | |
|---|---|
| ***B65G 15/00*** | (2006.01) |
| ***B65G 33/00*** | (2006.01) |
| ***E02F 3/08*** | (2006.01) |
| ***E02F 3/14*** | (2006.01) |
| ***E02F 5/00*** | (2006.01) |

(52) U.S. Cl. ..... 37/352; 37/387; 37/462; 37/465; 299/39.4; 299/39.9

(58) Field of Classification Search ..... 37/352–357, 37/362, 366, 367, 386, 387, 462–465; 299/39.1, 299/39.4, 39.7–39.9, 76, 78, 67; 404/90, 404/91

See application file for complete search history.

(56) References Cited

U.S. PATENT DOCUMENTS

| | | | | |
|---|---|---|---|---|
| 3,266,179 | A | 8/1966 | Golden | |
| 3,683,522 | A | 8/1972 | Rousseau | |
| 4,164,082 | A | 8/1979 | Watson | |
| 4,755,001 | A * | 7/1988 | Gilbert | 299/39.8 |
| 5,199,195 | A | 4/1993 | Scordilis | |
| 5,404,660 | A | 4/1995 | Webster | |
| 6,547,336 | B2 | 4/2003 | Hoffmann | |
| 2001/0038236 | A1 | 11/2001 | Hoffmann | |
| 2002/0056211 | A1 * | 5/2002 | Kelly et al. | 37/347 |

FOREIGN PATENT DOCUMENTS

| | | |
|---|---|---|
| DE | 1009157 | 5/1957 |
| DE | 1283165 | 11/1968 |
| DE | 3207104 | 9/1983 |
| DE | 19858151 | 6/2000 |
| EP | 0407934 | 1/1991 |
| IR | IE34028 | 1/1975 |

* cited by examiner

*Primary Examiner*—Christopher J. Novosad
(74) *Attorney, Agent, or Firm*—Sturm & Fix LLP

(57) ABSTRACT

An excavating apparatus having a prime mover with a longitudinal centerline and a main frame with an engine, a ground drive system and an excavation boom operatively attached thereto wherein the excavation boom has a first end and a second end. The first end of the boom is operatively pivotally attached to the main frame along a main frame pivot axis. The main frame pivot axis is transverse to the longitudinal centerline of the prime mover. A head shaft operatively rotatably attached to the second end of the boom and is operatively pivotally attached to the second end of the boom. Also, the excavation drum is mounted onto the head shaft in a manner that the excavation drum cooperates with the excavation chain and a fixed cutter pattern of the excavation chain to stay in consistent alignment with the fixed cutter pattern of the excavation drum.

4 Claims, 15 Drawing Sheets

EXCAVATION APPARATUS

CROSS-REFERENCE TO RELATED APPLICATIONS

This application is a Divisional of U.S. patent application Ser. No. 11/236,104 filed Sep. 26, 2005, now U.S. Pat No. 7,152,348 which is incorporated by reference herein in its entirety.

STATEMENT REGARDING FEDERALLY SPONSORED RESEARCH OR DEVELOPMENT

Not Applicable

BACKGROUND OF THE INVENTION

1. Field of the Invention

One aspect of the present invention relates generally to an excavator for breaking-up hard soils, rock, or concrete into manageable sized pieces for subsequent handling or processing. The excavator acts on an existing ground surface, acting on a layer of material to define a new ground surface that is below the original. The process is used for road construction and mining. This aspect of the present invention relates more particularly the apparatus, which allows control of the depth of cut and of the orientation of the resulting new ground surface.

2. Description of the Related Art

Road Bed Preparation

In the preparation of a road bed one critical function is to establish the proper lateral grade. In most cases the desired lateral grade is level, with the exception of regions where the road curves and a banking effect is desirable. In both cases, when constructing new roads the grade of the native topography will typically need to be modified to achieve the desired grade. Certain ground conditions prohibit excavation in a manner wherein very fine adjustments can be made. These include conditions of rock and very hard soils. In these conditions the surface is typically excavated below the desired level, and finer more manageable materials backfilled to bring the grade to the desired level.

The process of replacing a damaged road surface often begins with the step of removing the existing road surface. The current methods of removing existing road surfaces of concrete are complicated by the existence of steel reinforcing rod that is integral to the concrete road surface. Current techniques of breaking up the road surfaces are slow and labor intensive often including the use of some form of impact wherein the existing road surface is struck from the above and broken into smaller pieces, and at the same time separating the reinforcing rod.

Mining

Many types of non-metallic rock are mined from shallow open-pit mines called quarries. The process is known as quarrying, open cast or surface mining. One quarrying technique involves drilling and blasting to break the rock. When usable rock is found, the surface is cleared to expose the desired rock. The area being mined is then drilled and blasted, a large number of low-powered explosives detonated at the same time to shatter the rock. The drillings are controlled to a depth to stay within the strata of desirable rock, as may have been determined by preliminary exploratory drillings. A single blast produces as much as 20,000 tons of broken stone. The broken stone is then loaded by handling equipment and transported to additional equipment to be crushed into smaller pieces and separated into uniform classes by screening methods. During that time the broken stone is exposed to the elements and some may be affected by weathering damage. This process is relatively labor intensive, produces work-in-process subject to damage. New techniques are recently being developed.

One such technique of quarrying is labeled as percussive mining in U.S. Pat. No. 5,338,102. In this reference a percussive mining machine is utilized to successively strike or impact the material with a cutting tool. In this case the cutting tools are mounted to a rotating drum that is propelled on a mining machine. The mining machine illustrated includes components representative of many machines which have recently been developed for this application. The machines typically include some form of ground drive, supporting frame for the drum, power unit to provide power to rotate the drum, a conveyance mechanism and some form of height control, to control the position of the drum. Examples of other machines, built specifically for this application, can be found in U.S. Pat. Nos. 5,092,659; 5,577,808; and 5,730,501. These machines are highly specialized, with limited additional use.

An example of a more versatile machine, built on a more generic platform, can be found in U.S. Pat. No. 4,755,001. This reference discloses an excavating machine that consists of a digging head mounted to an elongated digging member, both mounted to a main frame. The main frame resembles machines currently known as track trenchers.

Track trenchers, as is illustrated in FIG. 1, were originally designed for forming trenches for the installation of drainage lines or other utilities in open trench installations. The basic components of a Track Trencher 10 include:

1) a main frame 30,
2) a set of ground engaging track assemblies 20 which are fixedly supported by the main frame 30 in a manner that allows the drive sprocket 22 to be driven to propel the machine along the ground,
3) a power unit 40 typically a diesel engine, and
4) an excavation boom assembly 50 which is relatively narrow, as compared to its length, as most trenches are much deeper than they are wide.

The power unit 40 provides power to the driven/drive components of the machine. This is typically comprised of a diesel engine and a hydraulic system. The hydraulic power is transferred to various actuators mounted on the machine to perform the desired operations including:

1) a hydraulic motor 24 mounted onto the track drive frame that drives the track drive sprockets 22,
2) a hydraulic motor 52 mounted on frame 30 that supports and drives a sprocket which drives the excavation chain 54 that is supported on an idler sprocket 56 which is supported by the boom frame 51, and
3) a hydraulic system that includes cylinders 62 to raise and lower the excavation assembly.

In trenching the primary parameter that needs to be controlled is the depth of the trench. The machine provides this control by controlling the position of the boom relative to the ground engaging tracks, typically allowing the boom to pivot around an axis defined by the machine frame. This pivot is designed robustly to handle the severe loading, particularly experienced when excavating rock. Typically the only movement of the boom relative to the frame is provided by pivoting about this axis.

Controlling the height of each ground drive unit, track, independently allows the frame to be kept level and thus the orientation of the resulting trench can also be controlled. However, this technique of orientation is not ideal in that the entire machine is being controlled resulting in higher power requirements and reduced responsiveness.

BRIEF SUMMARY OF THE INVENTION

The present invention relates generally to an excavation machine having a frame and an excavation boom. The excavation boom is rotatably mounted to the frame at a boom mount pivot axis. The excavation boom includes an excavating chain that drives an excavating drum, both rotating about an excavation axis. The boom further includes an integral pivot that allows the position and/or orientation of the excavating drum to be independently adjusted, relative to the frame and the boom mount pivot axis. The excavating drum and the excavating chain both include cutters mounted in a predetermined pattern. The predetermined pattern involves the placement of the drum cutters in relation to the chain cutters. The predetermined pattern does not change as the chain and drums are operated.

Road Bed Preparation

The apparatus of the present invention is particularly useful for the preparation of a road bed with its ability to control the orientation of the final ground surface along with the excavation depth. In addition the excavating drum's width, relative to the width of the ground engage tracks and the arrangement of the cutting teeth on the excavating drum make it particularly useful in demolition of an existing road surface in preparation to install a new road surface.

Mining

The apparatus of the present invention is particularly useful for certain types of mining operations with its ability to control the excavating drum to optimize the orientation of the ground surface and the excavating parameters.

DETAILED DESCRIPTION OF THE INVENTION

Figure 1:
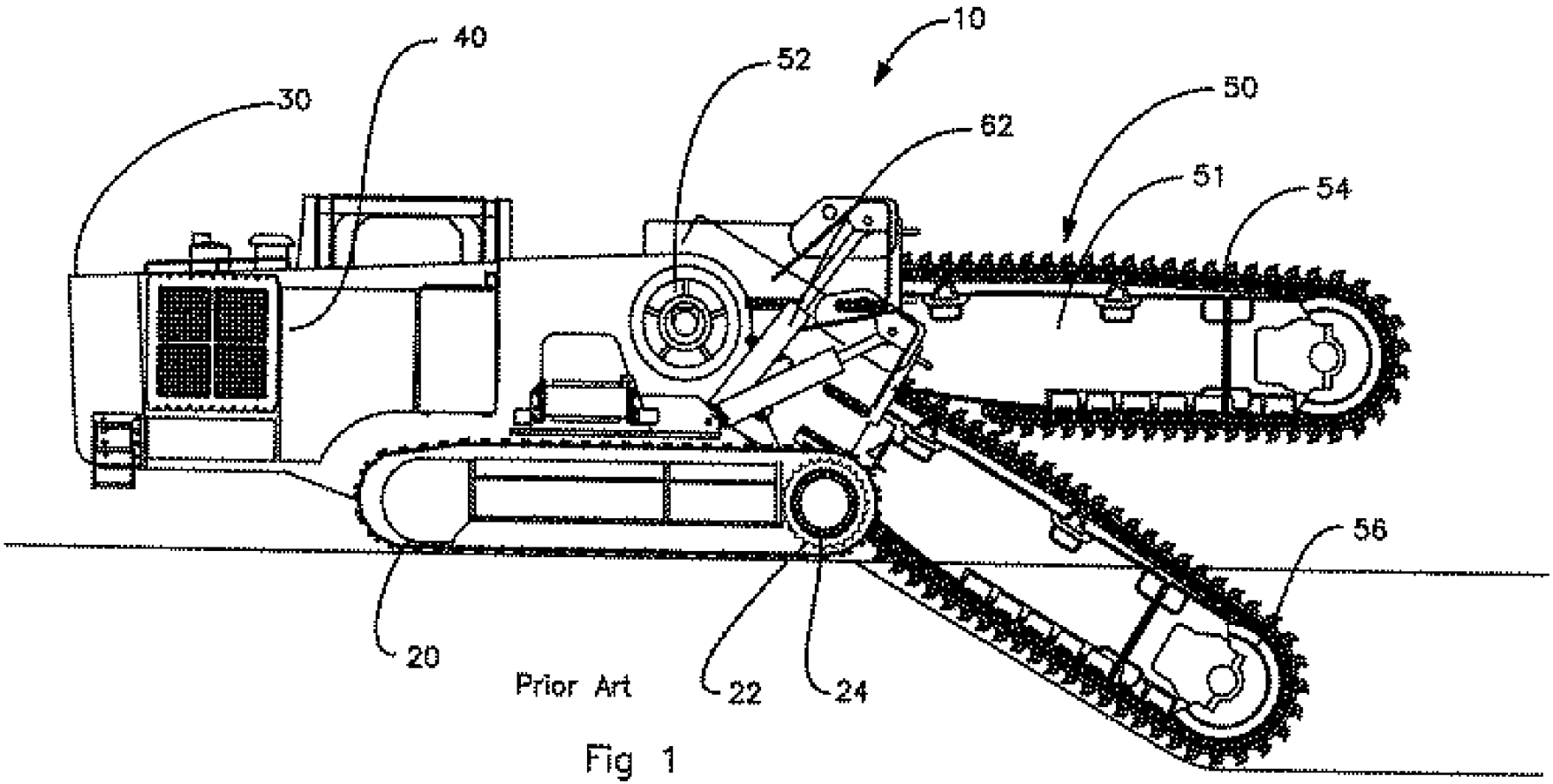
Prior Art Fig 1
FIG. 1 is a side view of the prior art track trencher with a standard boom.

Referring now to the drawings, like reference numerals designate identical or corresponding parts throughout the several views.

Figure 2:
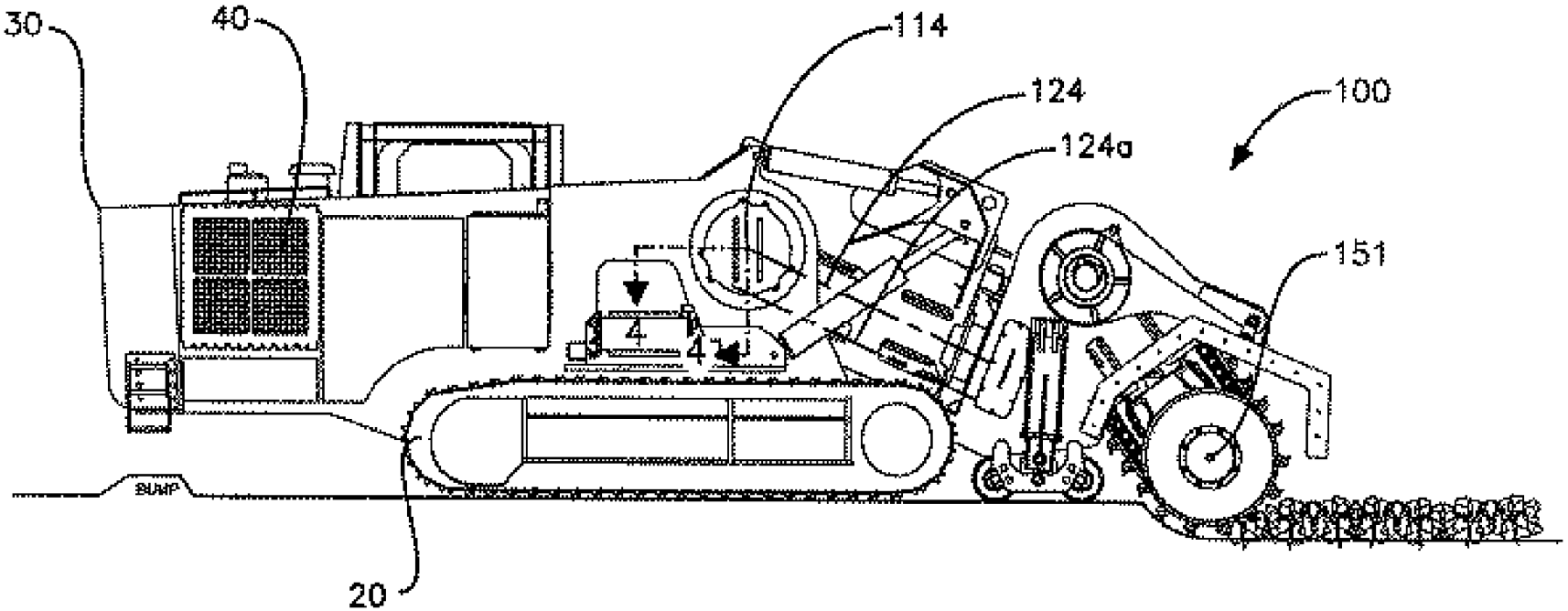
FIG. 2 is a side view of a track trencher with the boom of the current invention.
Figure 3:
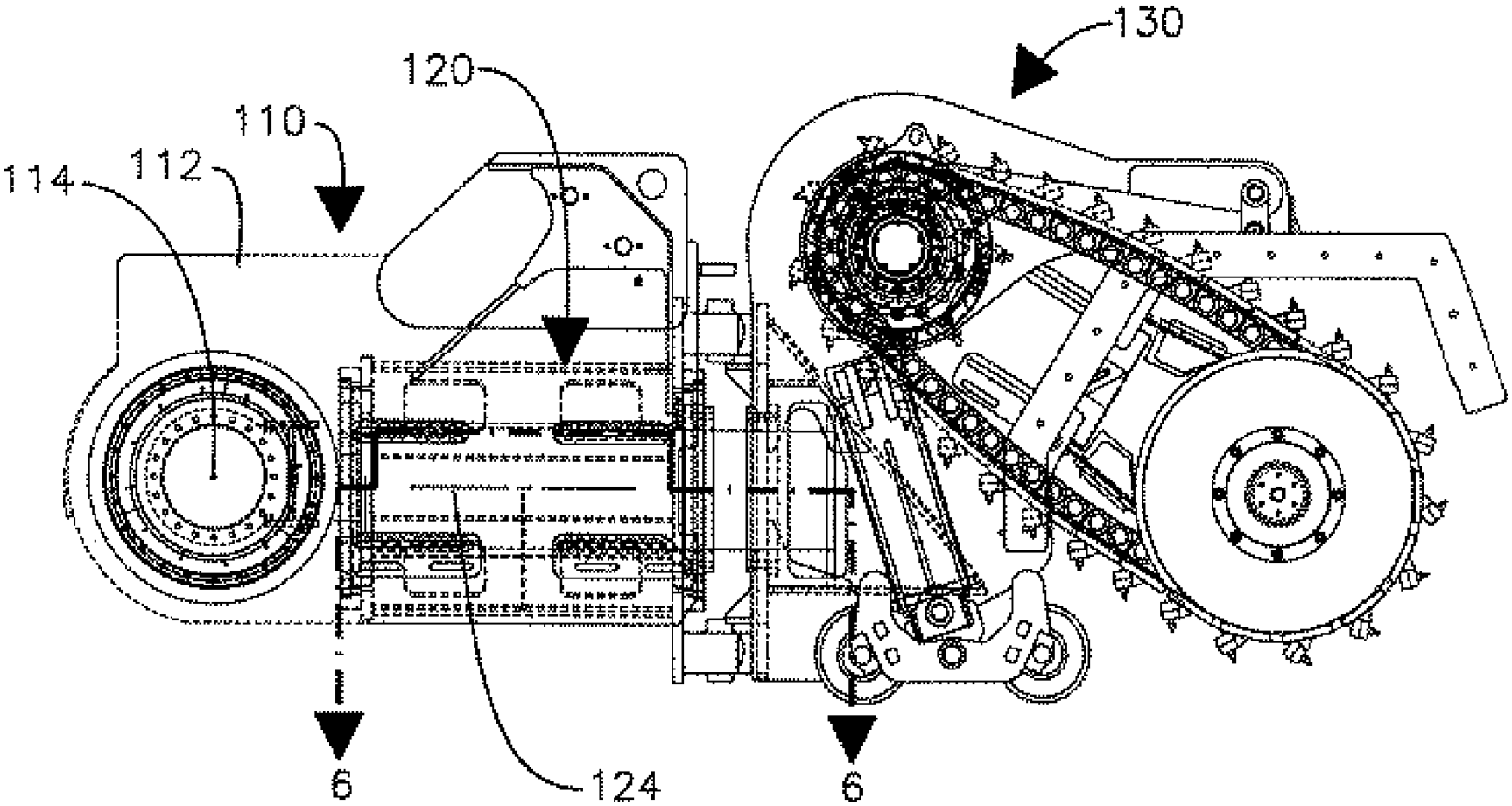
FIG. 3 is side view of the new boom.

The current invention includes a track trencher with a new excavation boom. A preferred embodiment is illustrated in FIGS. 2 and 3. In FIG. 2 the track trencher includes the basic components of the main frame 30, track assemblies 20, power unit 40; all with similar functions as described for the prior art track trencher. The excavation boom is replaced by a new excavation boom 100 of the present invention.

Figure 4:
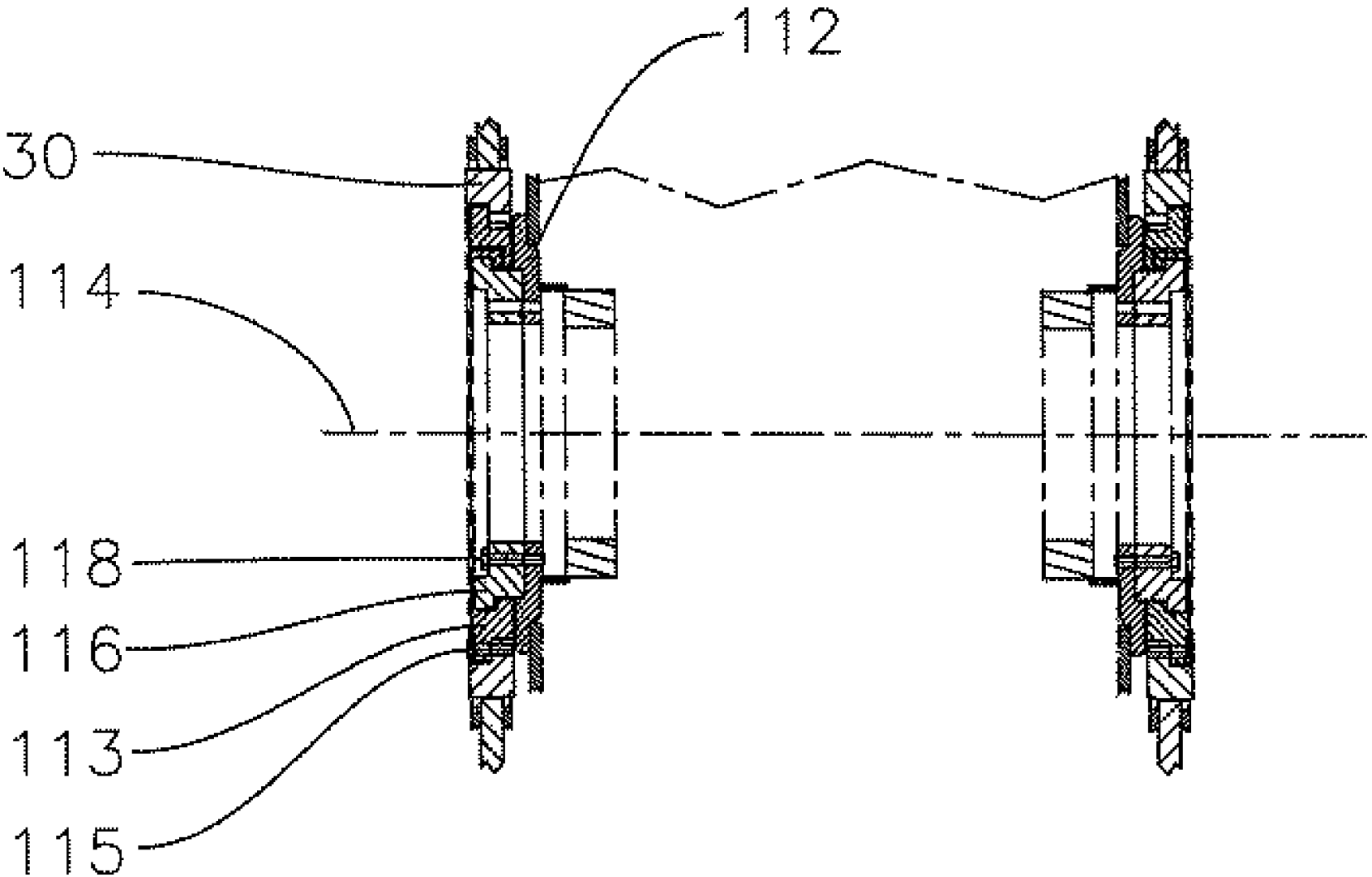
FIG. 4 is a cross-section of the main pivot taken along line 4-4 of FIG. 2.
Figure 5:
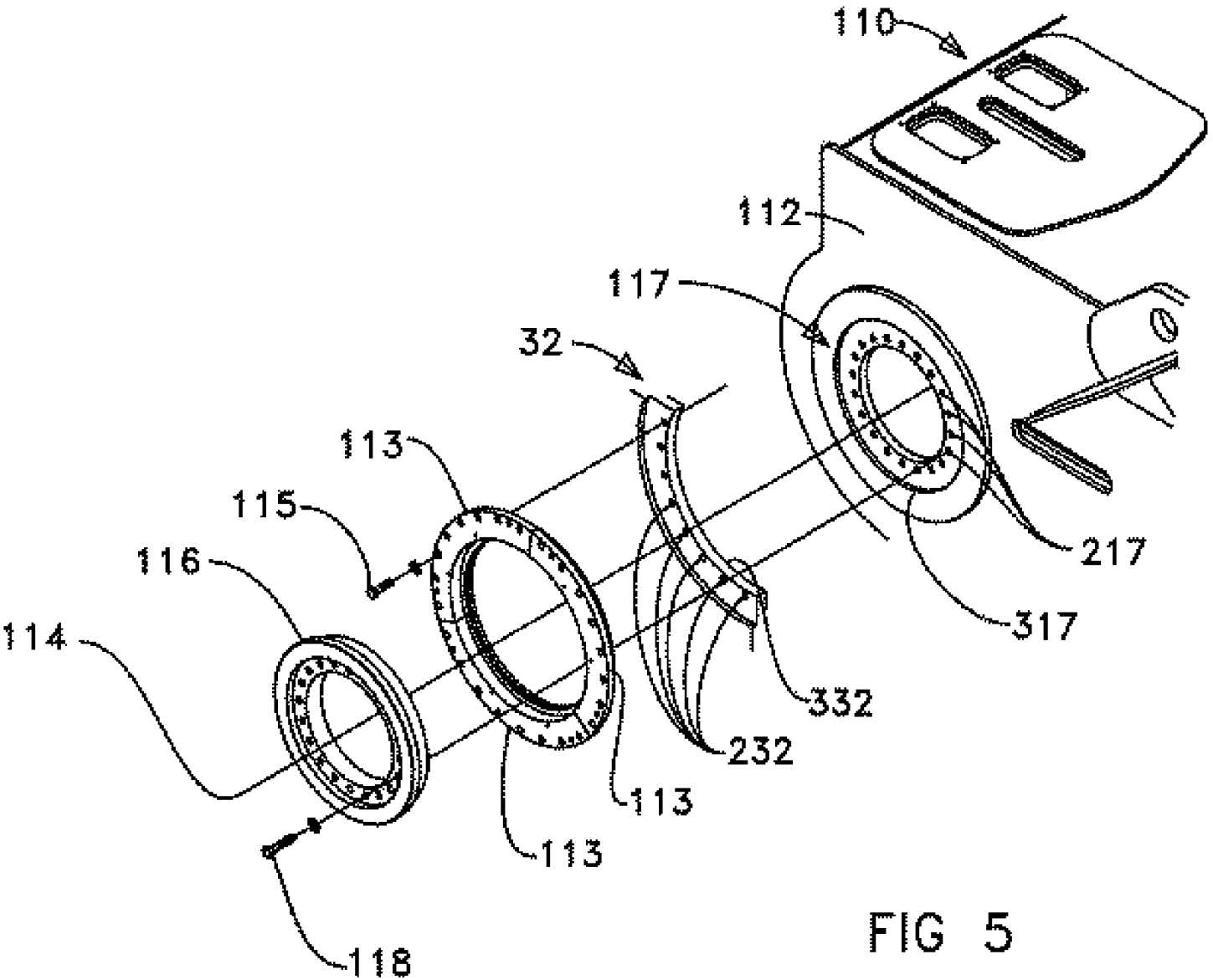
FIG. 5 is an isometric view of the main pivot.

The new excavation boom 100 is illustrated in FIG. 3 and includes a mounting section 110, swivel 120 and head unit 130. The mounting section 110 includes a mount frame 112 that will mate with the main frame 30 as illustrated in FIG. 4 and FIG. 5. The main frame 30 includes two coaxial holes with an array of tapped bolt holes, bolt patterns 32, which define the main pivot axis 114. Bolt pattern 32 is defined as including both the large diameter pilot hole 332 and the array of tapped holes 232 that fall on a bolt circle that is aligned with the pilot hole.

Outer pivot rings 113 attach to the main frame 30 with bolts 115 that are mated with bolt holes defining bolt pattern 32. Inner pivot rings 116 mate with the outer pivot rings 113, in a manner that they can freely rotate relative to the outer pivot rings 113 and frame 30. The inner pivot rings 116 attach to the mount frame 112 at bolt pattern 117 defined by pilot hole 317 and an array of tapped holes 217. There are two bolt patterns 117, one on each side of mount frame 112, that define an axis that passes through the centers of the two bolt patterns 117. This joint is assembled by first inserting the mount frame 112 into the main frame 30, then installing the inner pivot rings 116 into the pilot holes 317 though the sides of the frame 30. The inner pivot rings 116 are then attached to the mount frame 112 by installing bolts 118 that mate with tapped holes 217. The outer rings 113, which are constructed in 3 sections, are then installed and attached to the main frame 30 by installing bolts 115 that engage tapped holes 232. The excavation boom is thus able to pivot around the axis 114 to allow control of its position relative to the main frame.

Figure 6:
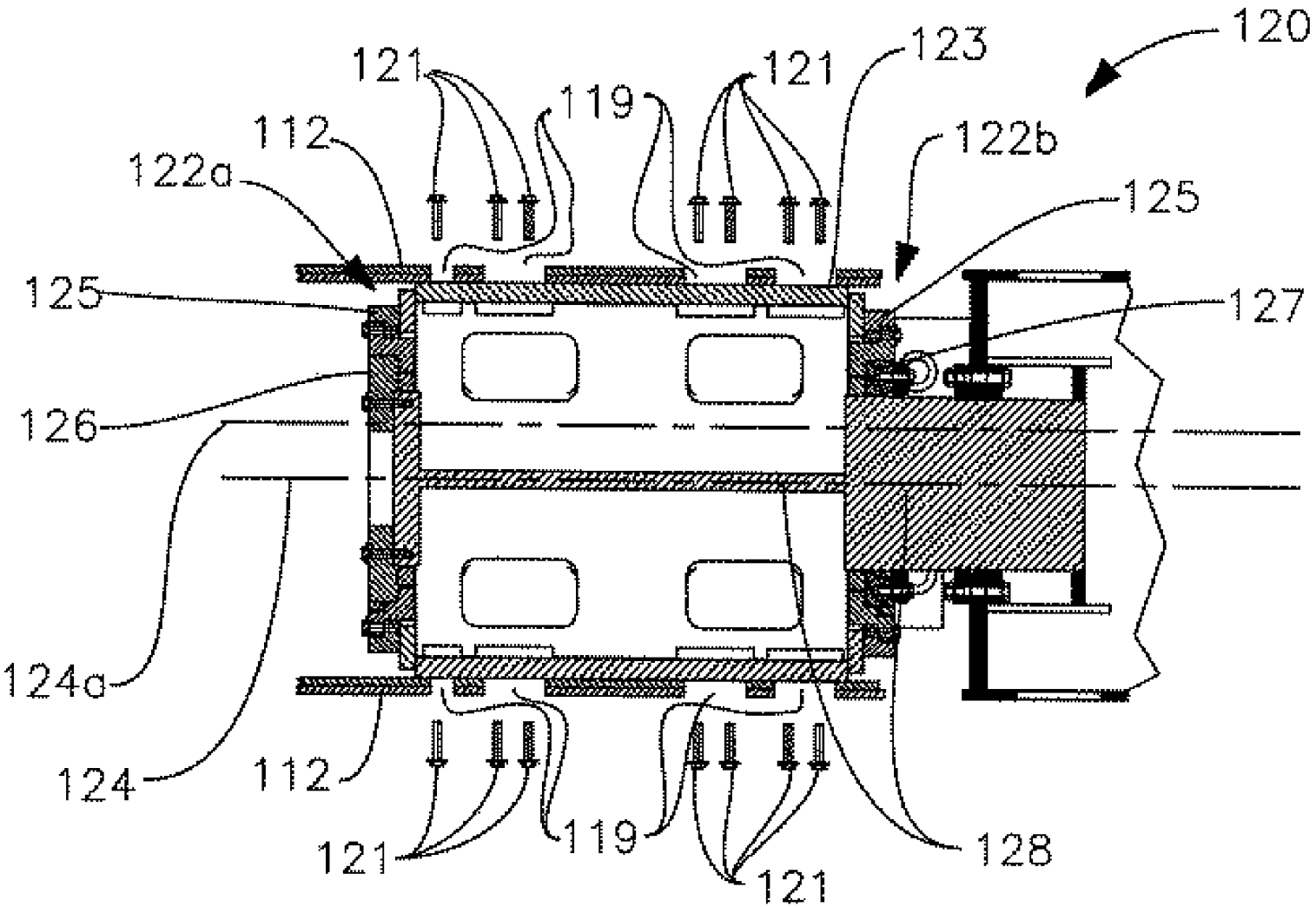
FIG. 6 is a cross-section of the swivel of the present invention taken along line 6-6 of FIG. 3.

FIG. 6 illustrates swivel 120 which includes a frame section 123, swivel shaft 128, inner pivot rings 126, 127, and outer pivot rings 125. The pivot rings 125, 126, and 127 form two rotary supports 122*a* and 122*b* defining a swivel or pivot axis 124. The rotary support 122*a* comprises an outer pivot ring 125 and an inner pivot ring 126. Rotary support 122*b* comprises an outer ring 125 and an inner ring 127. The outer rings of both rotary supports are constructed to be bolted to the frame section 123. The inner rings 126 and 127 are constructed to be bolted to swivel shaft 128. In this manner they provide both radial and longitudinal support of the swivel shaft 128. Frame section 123 is constructed to fit within the mount frame 112 of mounting section 110. It is secured to mount frame 112 with bolts 121 passing through the mount frame 112 at slots 119 such that the swivel or pivot axis 124 is perpendicular to and substantially aligned with main pivot axis 114, defined by the main frame 30 and substantially parallel to the ground surface, or the plane defined by the two track assemblies 20, as illustrated in FIG. 3.

As illustrated in FIG. 3 positioning the swivel axis 124 perpendicular to main pivot axis 114 allows the orientation of the head unit 130, which mounts on the swivel shaft, to be modified relative to main frame and ultimately the ground surface.

Figure 7:
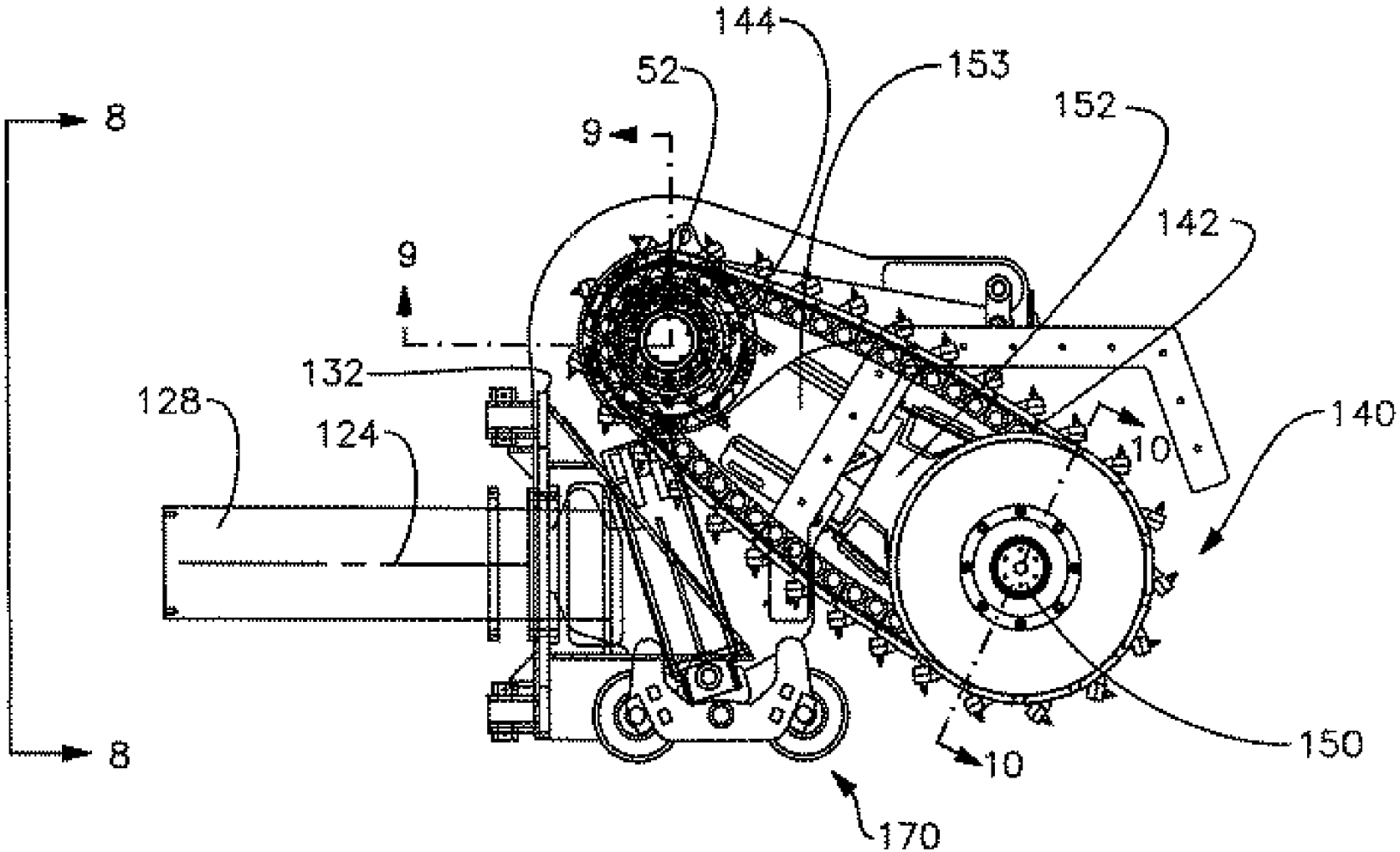
FIG. 7 is an enlarged side view of the head assembly of the new boom.
Figure 8:
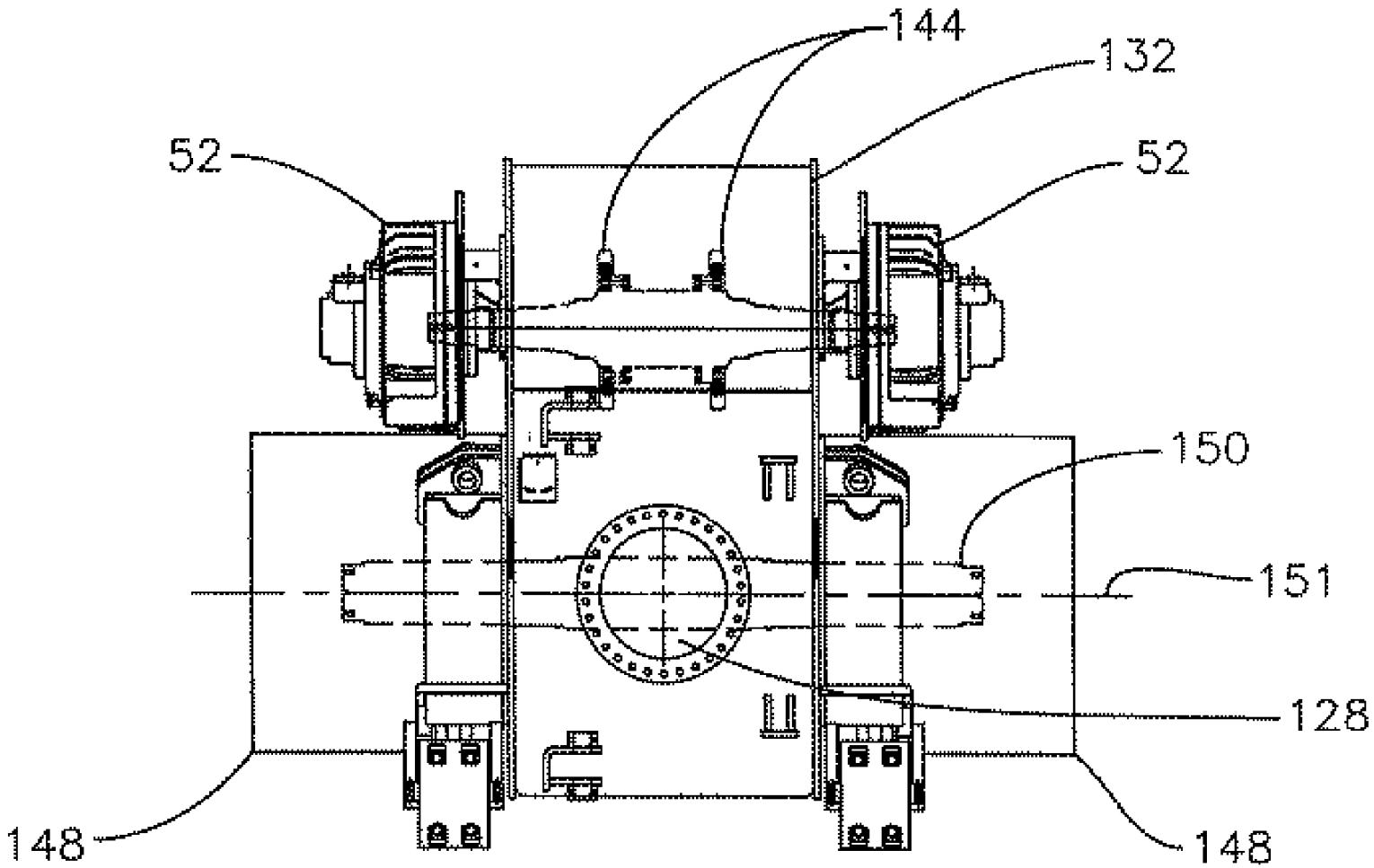
FIG. 8 is an end view of the head assembly of the new boom taken along line 8-8 of FIG. 7.
Figure 9:
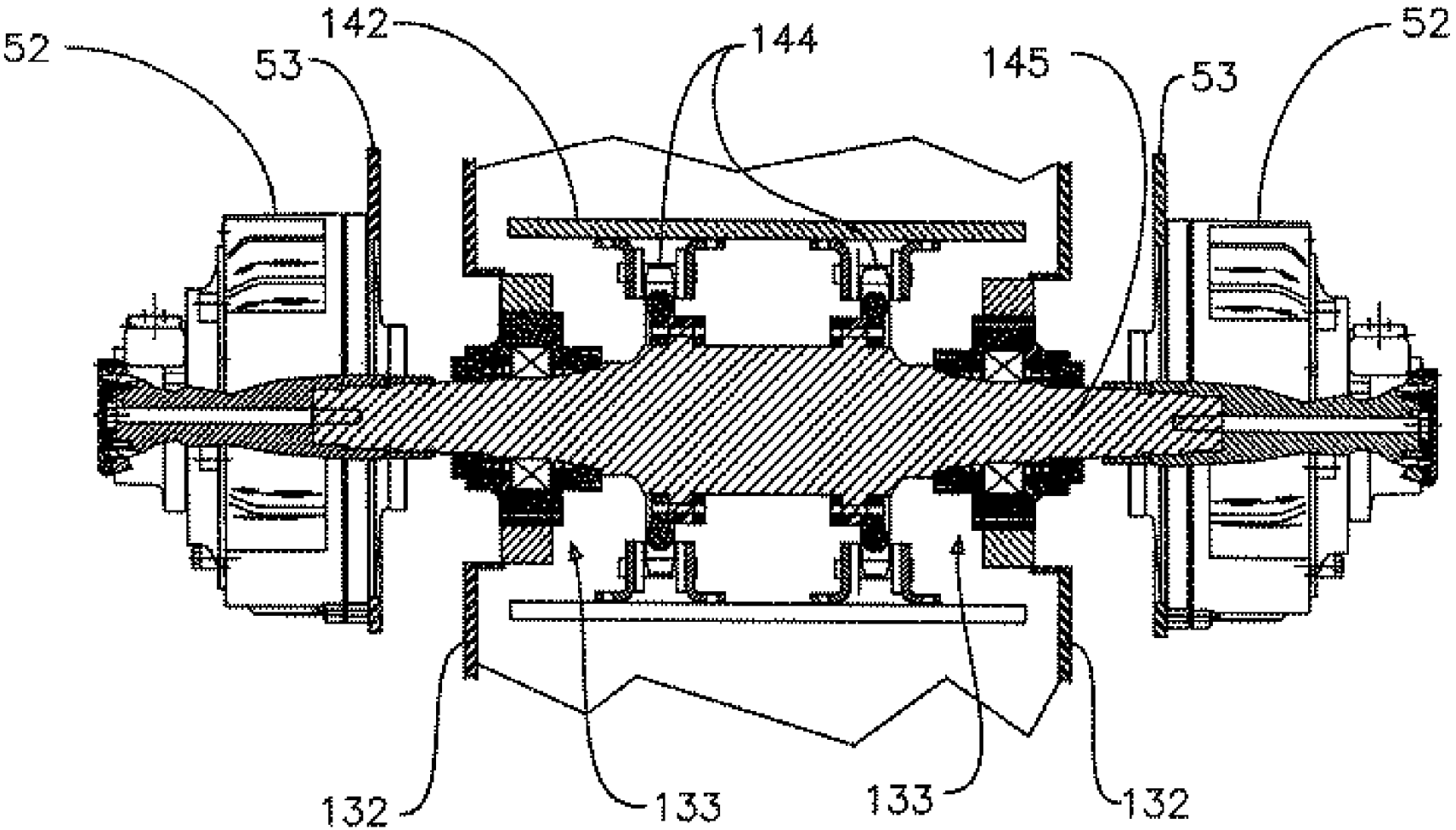
FIG. 9 illustrates the hydraulic drive motor and drive sprocket for the excavation chain.
Figure 10:
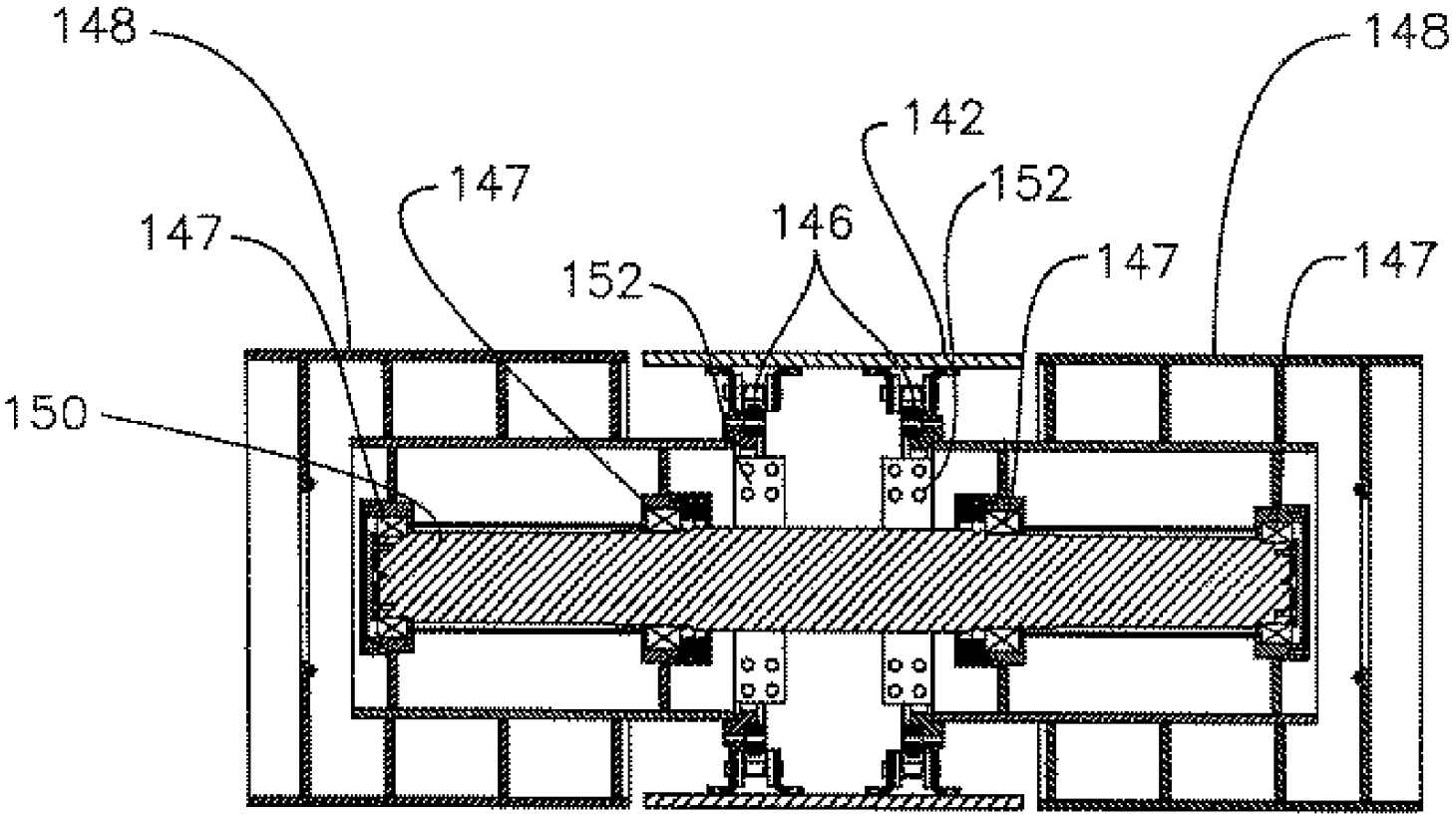
FIG. 10 is a cross section through the head shaft and the excavation drums of the present invention taken along line 10-10 of FIG. 7.

FIGS. 7 and 8 illustrate the head unit 130. It includes a frame section 132, an excavation assembly 140, and positioning assembly 170. The excavation assembly 140 comprises a center excavation chain 142, drive sprockets 144, driven sprockets 146 mounted on drums 148 which are rotatably mounted on head shaft 150 that is fixedly supported by extendable end section 152 of frame 132. The centerline of head shaft 150 defines the excavation head shaft axis 151. Power is transferred from the excavation hydraulic motors 52, that have been mounted onto the frame section 132 of head unit 130. Drive sprockets 144 are mounted onto motor shaft 145 which is supported in bearing assemblies 133 supported by frame 132. Hydraulic motors 52 are mounted onto motor shaft 145 and held from rotating by torque arms 53 as illustrated in FIG. 9. The drive sprockets 144 propel the excavation chain 142 which subsequently powers rotation of the sprockets 146. Sprockets 146 are fixedly mounted onto drums 148 such that whenever the sprocket rotates, the drums are also rotated. The excavation drums 148 are rotatably mounted onto head shaft 150 by bearings 147, as illustrated in FIG. 10. The extendible end section 152 is attached to the frame section 132 at joint 153. Joint 153 allows the extendible end section 152 to be moved perpendicular to the axis of rotation of the output shaft of drive motor 52 such that the distance between the drive sprockets 144 and the driven sprockets 146 can be adjusted to control chain tension.

Figure 11:
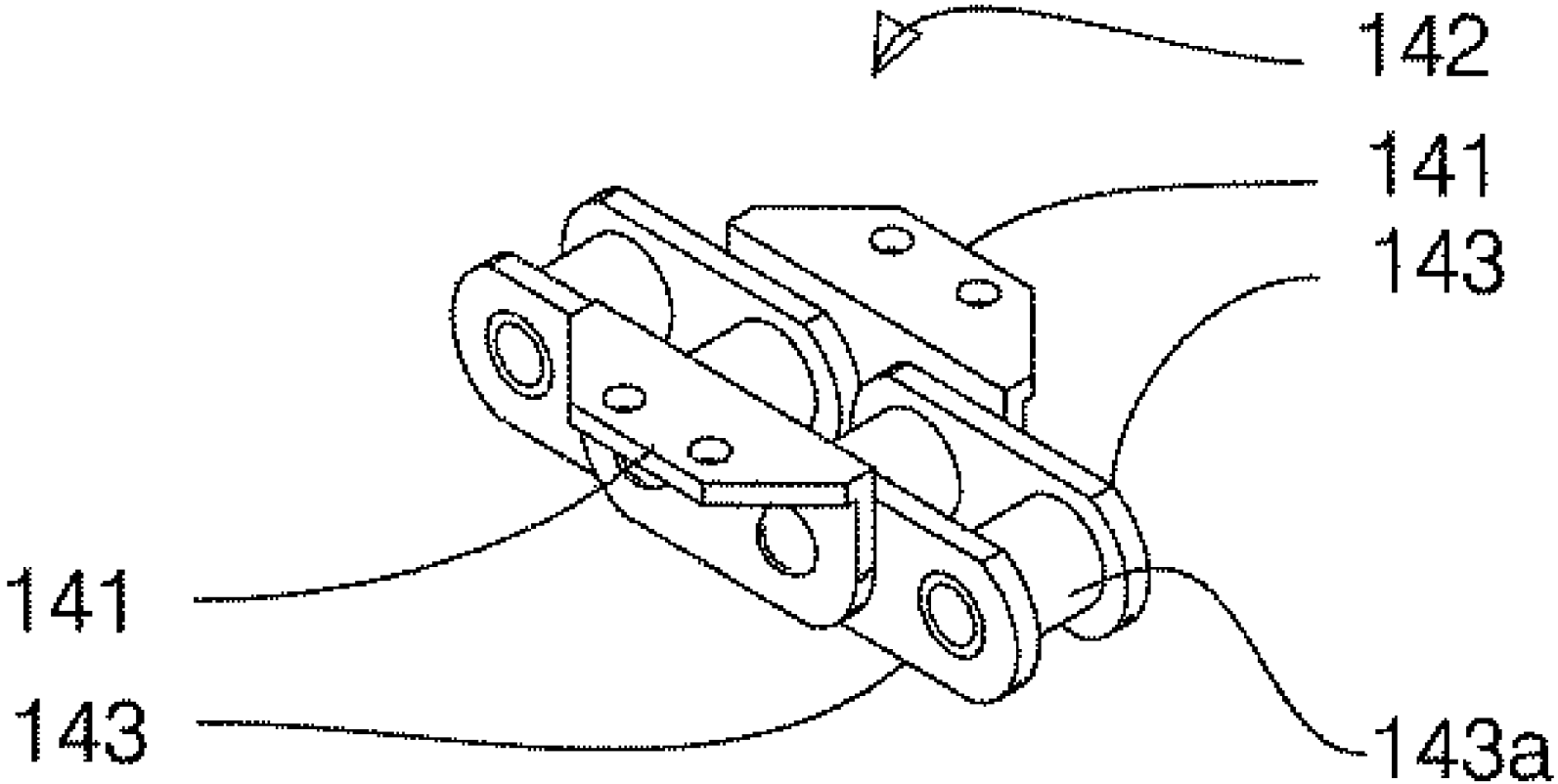
FIG. 11 is a perspective view of a portion of the excavation chain assembly.
Figure 12:
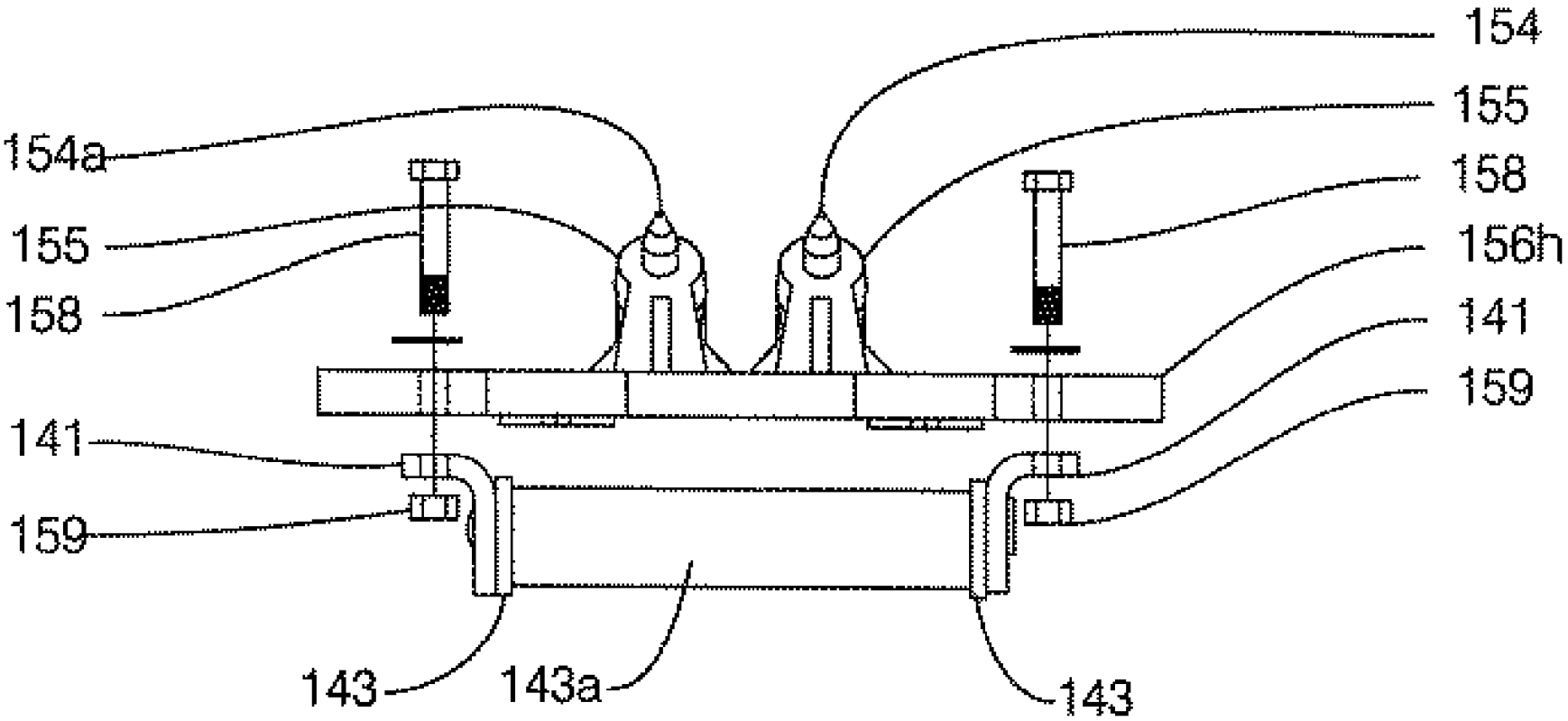
FIG. 12 is an exploded view of the base plates assembled onto the excavation chain.

Excavation chain 142 comprises external flanged side bars 141 and internal side bars 143 and rollers 143*a*, as illustrated in FIG. 11, and base plates 156, as illustrated in FIG. 12. Base plates 156 are typically bolted to the external flanged side bars 141 with bolts 158 and nuts 159 and include mounts 155 for supporting cutters 154. Cutters 154 are known in a variety of configurations. It is well known to attach such cutters to chain. Similar cutters are also known to be attached to rotatable drums. The type of cutter or method of mounting are not a portion of this invention, and any such cutter or mount would be useful.

Figure 13:
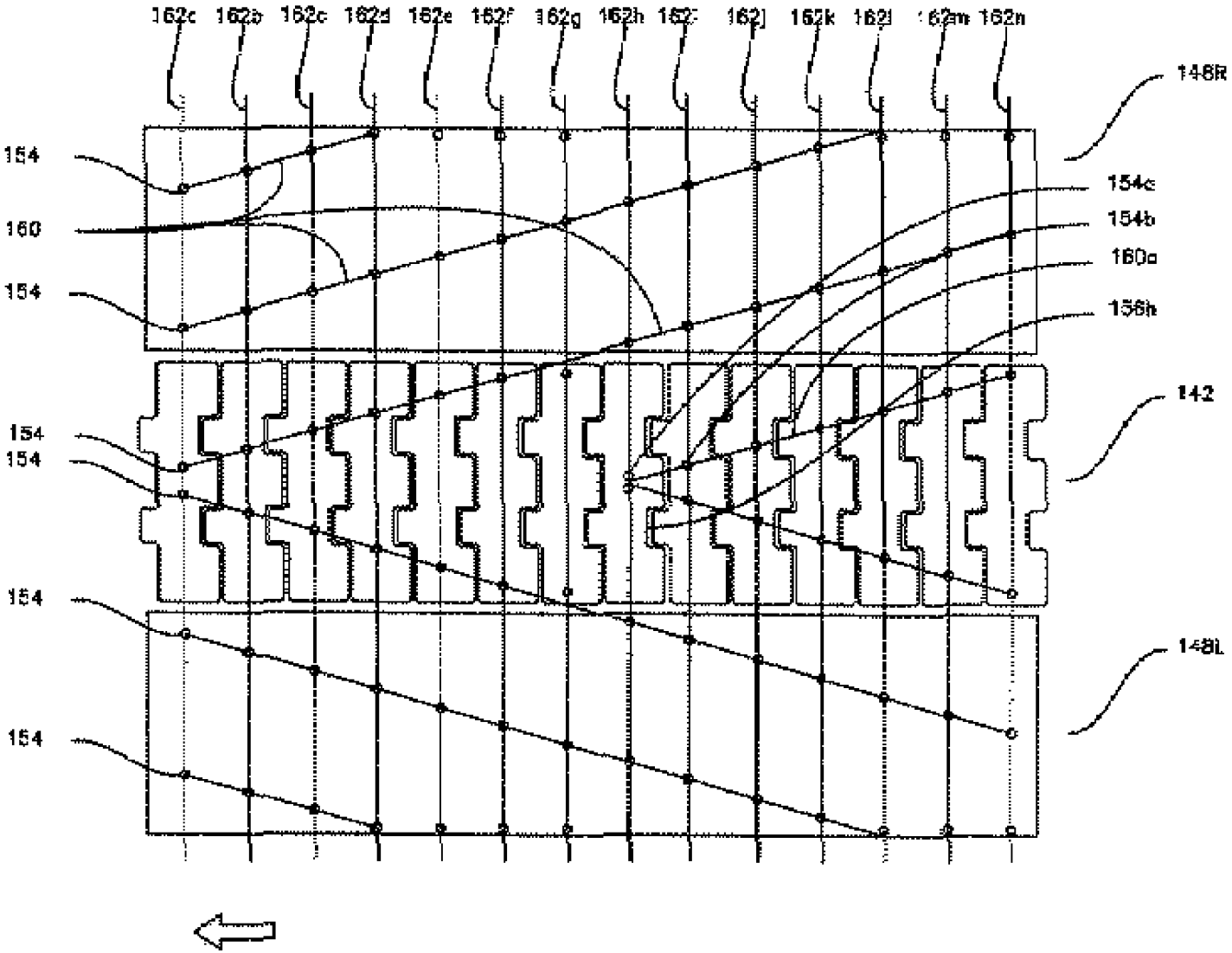
FIG. 13 illustrates the pattern of the cutters mounted on the excavation chain and drums.

FIG. 13 illustrates the outer circumference of the two excavation drums 148 shown as 148R and 148L, corresponding to one drum on the left and one on the right, along with the base plates 156 of the excavation chain 142. The pattern of the cutters 154, their location and placement and the coordination of this placement for the three separate components, has been found to be critical in optimizing the excavation efficiency of the assembly. One aspect includes the arrangement of the cutters 154 into rows 160 and columns 162. The columns 162 are parallel to the excavation axis, and spaced to coincide with the base plates 156. As the chain is rotated the outer circumference illustrated in this FIG. 13 effectively moves from right to left. Thus, column 162*a* contacts the ground surface first followed by 162*b*, followed by 162*c* etc.

Following one row 160*a*, the first cutter 154*a* is on column 162*h*. As the chain and drums are rotated this first cutter 154*a* will contact the ground surface, fracturing the surface and creating a groove. At column 162*i* the second cutter 154*b* is longitudinally spaced, away from the center of the base plate 156, towards the outer edge, as compared to the first cutter 154*a*. This longitudinal spacing defines the angle of the rows 160. The material contacted by the second cutter 154*b* will have been previously affected by the first cutter 154*a* on one side while on the other side the material will be less affected by any previous cutters. Thus, if any material fractures, there is a higher probability that it will be material between the groove created by the first cutter 154*a* and the groove now being created by the second cutter 154*b*, material on the inside of the second cutter 154*b*, than on the outside of the second cutter 154*b*. Thus material fractured by the second cutter 154*b* will tend to fracture towards the center of the base plates. As the chain and drum continue to rotate the cutters impacting the ground continue to move closer to the edge of the drum, in this case to the edge of drum 148R. As that row 160 approaches the edge, the longitudinal spacing of the last few cutters is decreased to approximately zero. This is necessary due to the fact that the loading at the ends will be influenced by the sides of the excavated trench. When plunge cutting there will be walls on each side of the excavation assembly 140. These walls will tend to force material against the outside teeth in such a manner that the loading is higher on these outside teeth.

The speed of the outer surface of excavation chain 142 must be coordinated with the speed of the outer surface of the drums 148R and 148L in order to maintain the relationship between the cutters mounted to the chain and the cutters mounted to the drums. To achieve this coordination the drums are sized to a specific outer diameter such that the one revolution of the excavation chain results in exactly an integer number of revolutions of the excavation drums. The pattern shown as 148R includes 28 cutters 154 and represents one complete rotation of the excavation drum 148. The pattern shown in FIG. 13 represents exactly ½, ⅓, or ¼ of the total length of the chain. Looking at an individual column there are always six cutters in each column, two on drum 148L, two on excavation chain 142 and two on drum 148R.

This cutter spacing and the coordination of the excavation chain length with outer diameter of the excavation drums results in consistent placement of the cutters 154 on the excavation drums relative to the cutters 154 on the excavation chain 142. There is an identical number of cutters 154 in each vertical row, and slightly increased density of cutters 154 on the two outside edges of the excavating drums 148L and 148R. Many patterns can be developed, the disclosed pattern comprising a V wherein the legs of the V-pattern pass from the chain to each of the drums, is one example but many others are possible.

Figure 14:
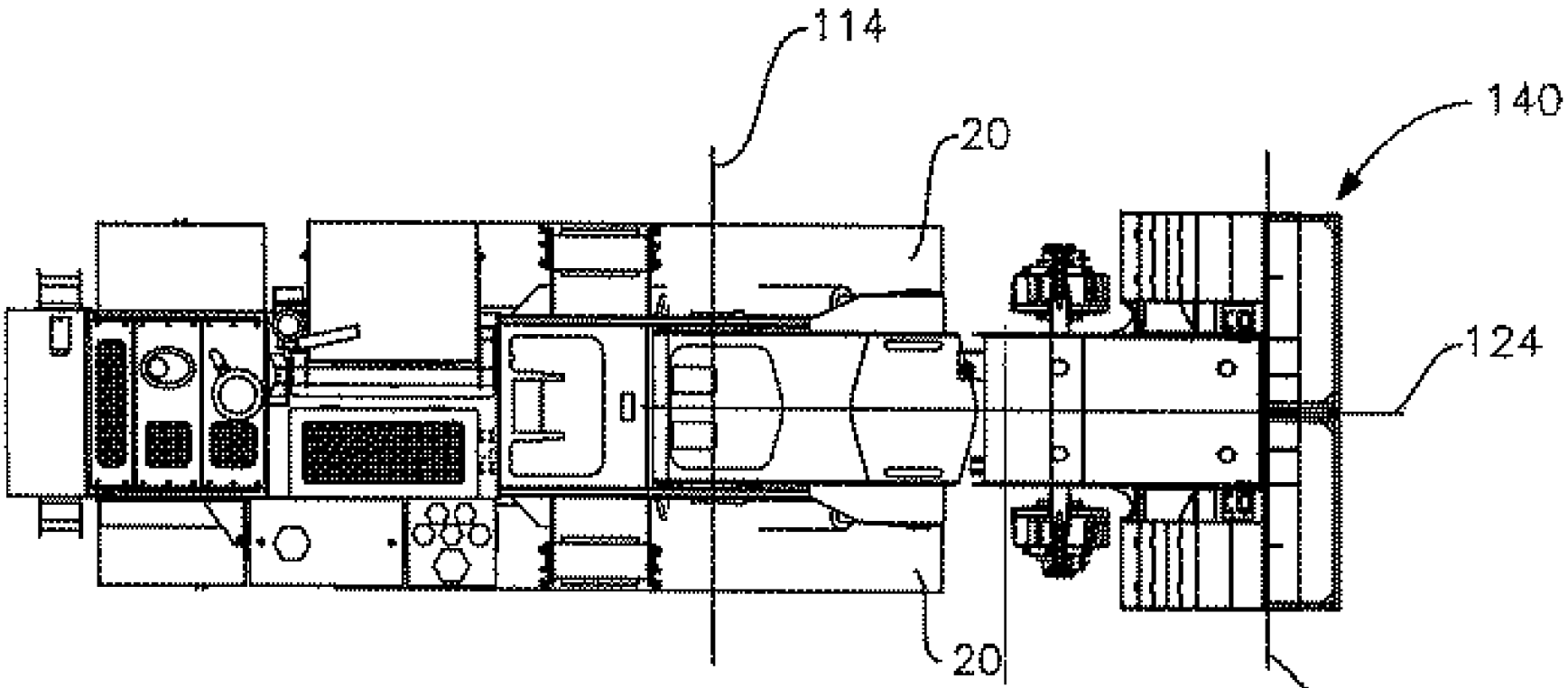
FIG. 14 is a top view of a track trencher with the boom of the current invention.

In operation the track trencher with the new excavation boom of the present invention is useful in surface mining or in surface preparation for road construction. The use of the track trencher for these applications is enhanced by the fact that the excavation assembly 140 always cuts wider than the tracks. One configuration is illustrated in FIG. 14 where the excavation assembly 140 is positioned with the excavation axis 151 parallel to the main pivot axis 114.

Figure 15:
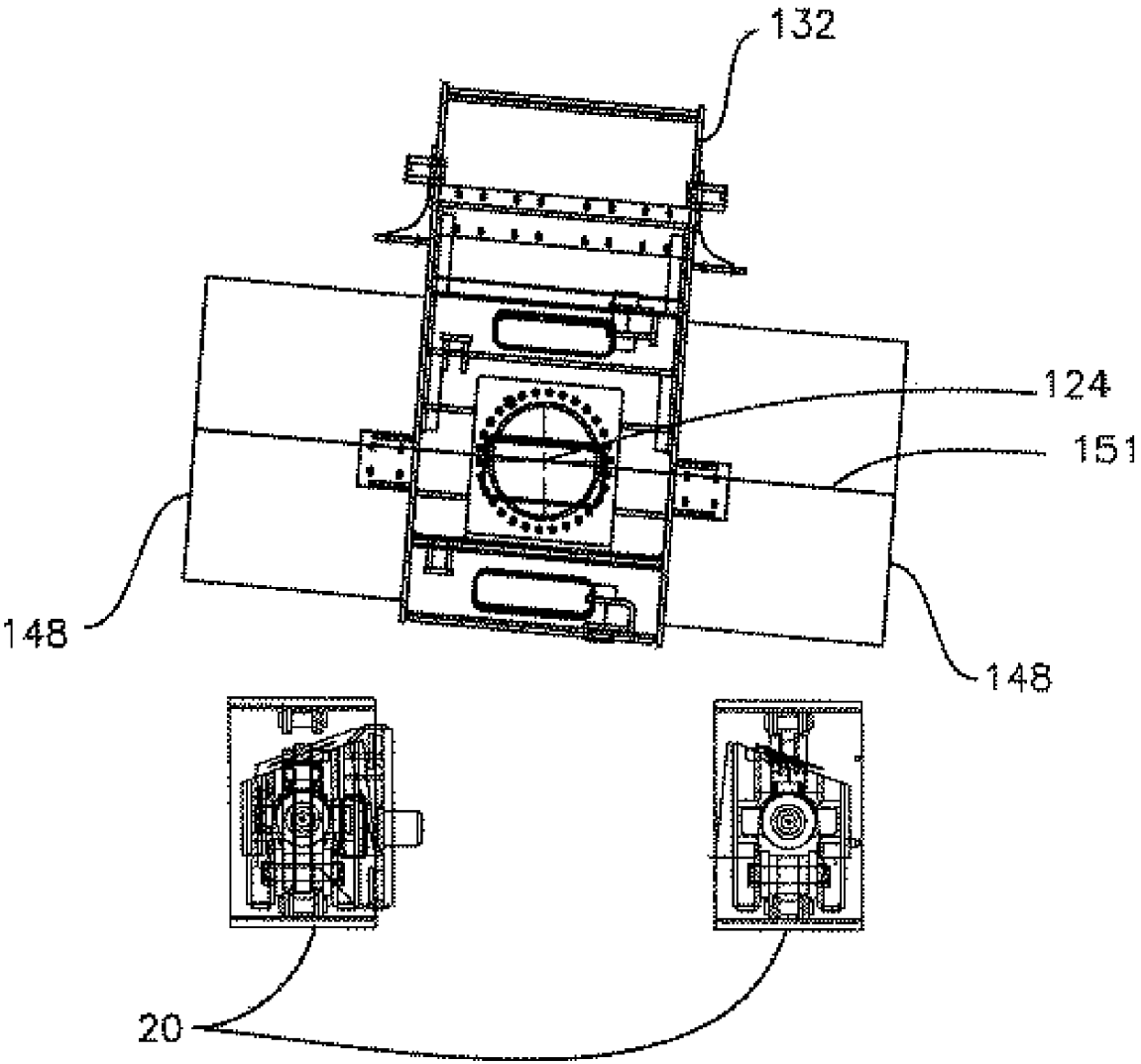
FIG. 15 is an end view of a portion of the track trencher and excavation boom of the present invention.

Another configuration is illustrated in FIG. 15 where the excavation assembly is tilted to its extreme position and excavation axis 151 is at the maximum angle to the tracks 20. In this configuration the swivel or tilt axis 124 is parallel to the longitudinal axis of the machine. Even in this extreme position the drum 148 will excavate wider than the tracks 20.

Obviously many modifications and variations of the present invention are possible in light of the above teachings. It is therefore to be understood that, within the scope of the appended claims, the invention may be practiced otherwise than as specifically described.

We claim:

1. A method of arranging cutters on an excavation drum and on an excavation chain, said excavation chain being used to drive the excavation drum via a driven sprocket and said excavation drum having a circumference, the method comprising:

operatively affixing a plurality of cutters to the excavation drum;

arranging the cutters operatively affixed to the excavation drum in a helix pattern around and along said excavation drum;

operatively affixing a plurality of cutters to the excavation chain; and arranging the cutters operatively affixed to the excavation chain in a periodic fashion, the excavation drum's circumference being an integer multiple of a period of said periodic pattern of the cutters operatively affixed to the excavation chain.

2. The method of claim 1 additionally comprising orienting the helix pattern of the cutters on the excavation drum to move excavated material toward a longitudinal center of the excavation drum.

3. The method of claim 1 additionally comprising extrapolating the helix pattern of the cutters on the excavation drum onto the excavation chain.

4. The method of claim 3 wherein the extrapolation results in a periodic plurality of "V" shaped patterns of the cutters on the excavation chain, apexes of the plurality of "V" shaped patterns being along a longitudinal centerline of the excavation chain.

* * * * *